United States Patent [19]

Dubuit

[11] 4,079,671

[45] Mar. 21, 1978

[54] NON-INTERFERING SQUEEGEE AND SCREEN SUPPORT ARRANGEMENT

[76] Inventor: Jean Louis Dubuit, 60 Rue Vitruve, 75020 Paris, France

[21] Appl. No.: 741,698

[22] Filed: Nov. 15, 1976

[30] Foreign Application Priority Data

Nov. 25, 1975 France ..... 75 35912

[51] Int. Cl.[2] ..... B41F 15/08; B41F 15/36; B41F 15/42

[52] U.S. Cl. ..... 101/124; 101/128.1

[58] Field of Search ..... 101/123, 124, 126, 128.1

[56] References Cited

U.S. PATENT DOCUMENTS

| | | | |
|---|---|---|---|
| 2,146,773 | 2/1939 | Sloan | 101/124 |
| 3,090,300 | 5/1963 | Dubuit | 101/123 |
| 3,533,353 | 10/1970 | Dubuit | 101/126 X |
| 3,762,318 | 10/1973 | Dubuit | 101/124 |
| 3,838,639 | 10/1974 | Harwell, Jr. et al. | 101/123 |

*Primary Examiner*—Ronald E. Suter
*Attorney, Agent, or Firm*—Diller, Brown, Ramik & Wight

[57] ABSTRACT

A silk screen printing machine comprises a frame, a pair of parallel spaced-apart levers pivotally mounted on opposed side walls of the frame, and a hydraulic or pneumatic cylinder connected to one of the levers for raising and lowering a pair of parallel bars of which one is connected between a pair of corresponding ends of the levers. A carriage for the silk screen is mounting for translational sliding movement on the bars. A transverse member is provided for supporting a squeegee carrier unit cooperable with the silk screen for printing on an object. A longitudinal bar parallel to the bars carries the transverse member and is secured at its ends beyond the limits of the stroke of the carriage along the bars to connecting links in which the bars are journaled at their ends.

6 Claims, 2 Drawing Figures

NON-INTERFERING SQUEEGEE AND SCREEN SUPPORT ARRANGEMENT

BACKGROUND OF THE INVENTION

The present invention relates generally to silk screen type printing machines, and more particularly to those described in French Pat. No. 1,263,239 and 1,315,719 which correspond generally to U.S. Pat. No. 3,090,300, incorporated herein by reference.

As is well known silk screen printing machines comprise a so-called silk screen of silk or another suitable fabric which forms a stencil is applied against an article to be printed and a squeegee associated with the screen and adapted to force ink through open meshes in the screen. In case the article to be printed is cylindrical the silk screen is subjected to translational reciprocation and the squeegee is held stationary, but when the article to be printed is flat the silk screen is held stationary and the squeegee is subjected to translational reciprocation.

It is also well known that it is necessary, after printing an article in a silk screen printing machine, to effect the disengagement of the silk screen relative to the article so as to enable the removal of the article and also to effect, concurrently, the relative disengagement of the squeegee with respect to the silk screen so as to permit the return stroke of the silk screen or the squeegee, depending on which reciprocates.

In the printing machines described in the above identified patents this problem is simply and satisfactorily solved by securing the silk screen to a carriage mounted for movement on two parallel bars which constitute the forward links of a four-bar linkage the rear links of which are the bars on which a drive carriage is mounted, the drive carriage being connected for translation with the silk screen supporting carriage for printing cylindrical articles, and by securing the squeegee to a vertical leg of a right-angled bracket which itself constitutes a carriage mounted for movement on the bars forming the forward and rear upper links of the four-bar linkage, which carriage is itself adapted to be connected for translation with the drive carriage, for printing flat articles.

After printing an article, whether it is flat or cylindrical, the forward links of the four-bar linkage carrying the screen and squeegee carriages are lifted vertically and simultaneously thereby disengaging or separating the screen with respect to the article to be printed and relatively disengaging or separating the squeegee with respect to the screen, precisely as desired.

But in machines of this type in which the disengagement or separating movement of the squeegee is effected mechanically by utilizing mechanical means which assure moreover the disengagement of the screen, it is necessary, keeping in mind that the squeegee carriage must be connected for translation with the drive carriage, to form the screen supporting carriage of two sufficiently spaced bracket arms so that the right angle bracket defining the squeegee carriage may be disposed therebetween. In other words, the connecting means provided for connecting the squeegee for movement with the bar forming the forward upper link of the four-bar linkage is connected to this bar at a point between the two bracket arms which, interconnecting the forward upper bar to the forward lower bar, defines in combination the screen carriage.

Inevitably the maximum permissible stroke of the screen carriage along the bars is determined, independently of the length of these bars, by the presence of the squeegee carriage between the bracket arms which make up the screen carriage; in the machines of this design, the screen carriage has, then, a limited stroke when printing cylindrical articles.

SUMMARY OF THE INVENTION

A general object of the present invention is an arrangement to overcome this drawback by making use of the possibility; known per se, to assure by independent means the disengagement movement of the squeegee with respect to the screen, for example pneumatically.

According to a more particular object of the invention a silk-screen printing machine is provided comprising a frame, two parallel spaced-apart levers pivotally mounted on said frame, a first bar interconnecting a pair of corresponding ends of said levers, a second bar generally parallel to said first bar, a carriage movably mounted for translation along said bars and adapted to support screen frame members, means securing said bars relative to each other for raising and lowering movement in unison into or out of operative position, means for pivoting one of said levers for moving said bars into or out of said operative position, a longitudinal member being disposed generally parallel to said bars and supporting a transverse member which is adapted to support a squeegee carrier unit, means for fixing said longitudinal member relative to said bar for raising and lowering movement therewith being disposed to each side of said carriage effectively beyond the limits of the translational path of movement thereof.

Thus the connection of the squeegee carrier unit transverse member with said bars which while effecting vertical movement simultaneously with the movement of the associated screen carrying carriage, independently of vertical movement proper of the squeegee with respect to the screen, in no way interferes with the connection to said bars of said screen carrying carriage.

In practice the connection of the squeegee carrier transverse member may be removed to the ends of said bars, which may be effected by means of connecting rods or links connecting the ends of said bars, whereby the entire length of said bars may be utilized for the effective course of the screen carrying carriage.

Other features and advantages of the present invention will be brought out moreover in the following description, with reference to the accompanying schematic drawing.

DESCRIPTION OF THE PREFERRED EMBODIMENT

Figure 1:
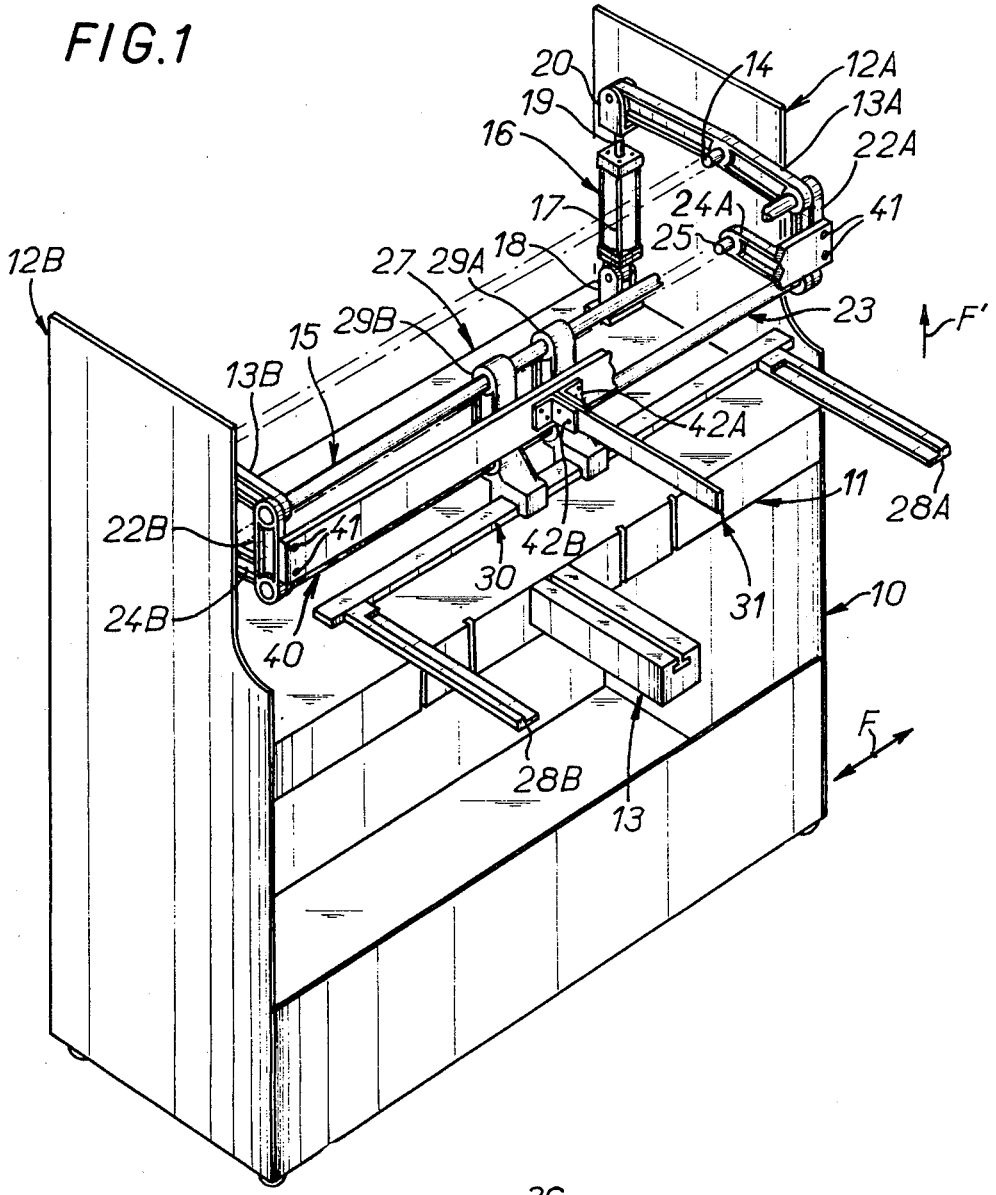
FIG. 1 is a perspective view, partially cutaway, of parts of a silk screen printing machine embodying the invention.

In the preferred embodiment illustrated in FIG. 1 the frame of the silk-screen printing machine, designated by the general reference numeral 10, comprises a table or bed 11 and two upright side walls 12A–12B.

Projecting from the front side of the bed 11 of the machine is a strut 13 which is adapted to received, in a manner known per se, means (not shown) adapted to support the article to be printed on.

Two levers 13A and 13B are pivotally mounted parallel to each other on the side walls 12A and 12B of the frame.

In the illustrated embodiment the levers 13A, 13B are mounted for pivotable movement about the separate ends of horizontal pivots 14 which are axially aligned with each other, of which only one pivot 14 is shown in FIG. 1. It goes without saying, as shown in phantom lines in FIG. 1 and as disclosed in the aforesaid patents, that the pivots 14 may be the ends of a single bar or shaft running between the side walls 12A and 12B.

One pair of the ends of each of the levers 13A, 13B facing each other are connected to each other by a first horizontal bar 15 which is illustrated as a cylindrical bar. At the opposite end of lever 13A means for effecting pivotal movement are fastened. In the present embodiment this means is a hydraulic cylinder 16 the body of which is pivotally mounted on a clevis 18 mounted on the bed 11 and the piston rod 19 of which carries a clevis 20 by which the cylinder 16 is secured to the opposite end of the lever 13A.

At the ends of the bar 15, beyond the levers 13A, 13B, connecting links 22A, 22B are journaled for connecting the first bar 15 to a second bar 23 disposed parallel to and below the first bar. In the illustrated embodiment the second bar 23, as is the first bar 15, is generally cylindrical. Likewise in a manner taught by the above-mentioned patents the second bar 23 connects connecting links 24A and 24B pivotally mounted on the frame 10 parallel to each other and parallel to the levers 13A and 13B.

The connecting links 24A, 24B are journaled on the separate pivots 25 which are in axial alignment with each other, although only one pivot 25 is shown in FIG. 1. However it goes without saying that, as with the pivots 14, and as illustrated in phantom lines in FIG. 1, the pivots 25 may be the ends of a single bar connected between the end walls 12A and 12B of the frame 10.

In any event, and as described in the above-mentioned patents, the bars 15 and 23 constitute the upper and lower forward links of a four-bar linkage controlled by cylinder 16, and are movable between a lowered working or operative position and a raised retracted position.

A carriage 27 is mounted on the bars 15 and 23 between their connecting links 22A, 22B and serves as a support for screen frame members 28A, 28B which are disposed generally horizontally perpendicular to the bars 15 and 23, and on which, in a known manner and therefore not described in detail here, a silk screen per se for a particular article may be brought into position.

In the illustrated embodiment the carriage 27 comprises two bracket members 29A, 29B slidingly mounted on the bars 15 and 23 and spaced from each other, and joined at their lower ends by a third bar 30 disposed parallel to the first two bars 14 and 23, the screen frame members 28A and 28B being secured at right angles to the ends of this third bar.

Figure 2:
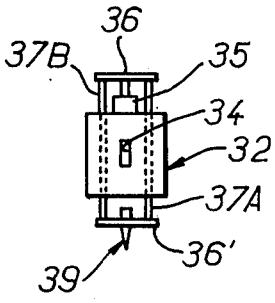
FIG. 2 is a side elevational view of a squeegee carrier alone, adapted to be employed in the present printing machine.

The printing machine according to the invention comprises in addition a transverse member 31 which is disposed generally horizontal perpendicular to the bars 15 and 23, above the screen frame members 28A and 28B and parallel thereto. This transverse member 31 is suited for supporting a squeegee carrier unit 32 shown alone in FIG. 2. Connecting means are moreover provided between the transverse member 31 and the bars 15 and 23 for fixing the transverse member 31 to the bars 15 and 23 for movement during vertical raising movement of bars by means of the cylinder 16.

As is known per se, the squeegee carrier unit 32 has a passage 34 through which it may be received on the transverse member 31 and a hydraulic cylinder 35 carried on the top side of the carrier unit 32 and having its piston rod connected by means of two cross bars 36, 36' defining two opposed sides of a frame whose two other sides are the uprights 37A, 37B slidably mounted in the unit 32. The unit also comprises the squeegee per se 39 extending from the lower side of the unit 32 and mounted for vertical displacement in the unit by means of the hydraulic or pneumatic cylinder 35, transversely relative to the bars 15 and 23.

Means (not illustrated) for locking the squeegee carrier unit 32 on its cross member 31 may, as is known, be provided.

According to the invention connecting means are provided for fixing the transverse member 31 for movement with the bars 15 and 23 comprises a longitudinal member 40 disposed parallel to the bars 15 and 23 carrying the transverse member 31 projecting therefrom. The longitudinal member is fixed for movement with bars 15 and 23 at points to each side of the carriage 27 and effectively beyond the translational stroke thereof.

In the illustrated embodiment the longitudinal member 40 comprises a bar of rectangular cross section which is disposed forward of the cylindrical bars 15 and 23 and in front of the carriage 27 displaceably mounted thereon, the longitudinal member 40 being fixed to the connecting links 22A, 22B and thereby fixed for movement with the bars 15 and 23 through the connecting links.

Preferably, and for reasons which will appear hereinafter, the longitudinal member 40 is detachably mounted to the connecting links 22A, 22B, for example by means of screws 41 such as illustrated. Similarly the transverse member 31 is preferably detachably mounted on the longitudinal member 40 on which it is carried, for example by means of angles 42A, 42B screwed on the longitudinal member.

The machine according to the invention comprises in addition means for effecting the reciprocation of the carriage 27 on bars 15 and 23 as a cylindrical article is printed here. These means, which are not part of the invention per se and are known in the art, need not be described in detail here.

It could, however, be brought out here that in case, as described in the above mentioned patents: the pivots 14 and 25 of the bars form the ends of bars extending between the side walls 12A, 12B of the frame; these means for effecting reciprocation may comprise a drive carriage displaceably mounted for sliding movement along the bars, the drive carriage may itself be driven for sliding movement by cam means or alternatively driven for sliding movement by securement to an endless belt passing over two pulleys, one of the pullers being fixed for rotation with the shaft of a double-action motor means with double direction reversing switches in the supply circuit which are alternately actuated when the carriage 27 completes its stroke. In this case the direction reversing switches may be carried on the longitudinal member 40 to each side of the transverse member carrying the squeegee carrier unit 32.

According to a modified embodiment the drive means for effecting the sliding displacement of the carriage 27 may also be directly applied to the carriage 27 and may comprise a pneumatic cylinder or a cable to which the carriage 27 is fastened and which passes over two pulleys one of which is fixed for rotation with the outlet shaft of a reversing output motor, coacting with direction reversing switches, as herein. In this case, in fact, the cable itself absorbs or takes up the vertical displacements of the carriage 27.

In any case, when printing on a cylindrical article the carriage 27 is controlled for reciprocating movement along the bars 15 and 23 as indicated by the double headed arrow F in FIG. 1.

In one direction of translation of the carriage 27, the bars 15 and 23 are in their lowered operative position, as shown in solid lines in FIG. 1; the screen carried by the screen frame members 28A, 28B is in contact with the article to be printed on; and the squeegee 39 carried by the squeegee carrier unit 32 is in contact with the screen; the desired printed matter is then imparted.

At the end of the stroke of the carriage 27, the bars 15 and 23 are raised vertically by means of the cylinder 16 as indicated by the arrow F' in FIG. 1 and from their lowered position to their raised position (not shown), carrying along with it the screen frame members 28A, 28B, so that the screen carried by the frame moves out of contact with the just printed article, the transverse member 31 carrying the squeegee carrier unit 32 so that the squeegee 39 follows the retractive movement of the screen with which it is in operative engagement.

Concurrently the cylinder 35 to which the squeegee 39 is secured is actuated, imparting a supplementary retracting movement with respect to the subjacent screen.

Afterwards, during the return stroke of the carriage 27, corresponding to translation in the opposite direction to the previous translational movement, the screen carried by the screen frame members 28A, 28B is moved out of contact with the just printed article, and the squeegee 39 carried by the squeegee carrier unit 32 is moved out of contact with the screen.

At the end of the return stroke of the carriage 27, the cylinder lowers the bars 15 and 23 carrying the carriage 27 and at the same time the cylinder 35 once again brings the squeegee 39 into contact with the subjacent screen.

A new operating cycle can then start.

In order to print on flat articles it is sufficient to detach the longitudinal member 40 and remove the transverse member therefrom and to secure the transverse member on the carriage 27 and fasten the bar 30 to the connecting links 22A, 22B in place of the longitudinal member 40, for example by means of angles (not shown).

The present invention is of course not limited to the illustrated and described embodiment but covers all alternatives and expedients described briefly herein within the scope of the accompanying claims.

What I claim is:

1. A silk screen printing machine comprising a longitudinally elongated frame, two parallel longitudinally spaced-apart levers pivotally mounted on said frame, a first bar interconnecting a pair of corresponding ends of said levers, a second bar disposed generally parallel to said first bar, a carriage movably mounted for translation along said bars and having means for supporting screen frame members, means securing said bars relative to each other for raising and lowering movement in unison into or out of operative position, means for pivoting one of said levers for moving said bars into or out of said operative position, a longitudinally extending member disposed generally parallel to said bars and supporting a transversely extending member forming means for supporting a squeegee carrier unit, means for fixing said longitudinally extending member relative to said bars for raising and lowering movement therewith being disposed to each side of said carriage beyond the limits of the translation of said carriage on said bars, said means for securing said bars relative to each other including a pair of spaced-apart connecting links with said first and second bars being journaled in said connecting links, said means for fixing said longitudinally extending member relative to said bars fixing it to said connecting links.

2. A machine according to claim 1 wherein said longitudinally extending member is disposed on the same side of said bars and said carriage movably mounted on the same side of said bars as is said transversely extending member.

3. A machine according to claim 1, wherein said means for fixing said longitudinally extending member comprise a detachable fastening means.

4. A machine according to claim 1, wherein said longitudinally extending member is of elongated rectangular configuration.

5. A machine according to claim 1, wherein the squeegee carrier unit is slidably mounted on said transversely extending member.

6. A machine according to claim 1, further comprising two other parallel spaced-apart levers pivotally mounted on said frame; said second bar interconnecting a pair of corresponding ends of said other levers.

* * * * *